US006216582B1

(12) United States Patent
Saito et al.

(10) Patent No.: US 6,216,582 B1
(45) Date of Patent: Apr. 17, 2001

(54) SWASH PLATE TYPE COMPRESSOR IN WHICH A RIVET MEANS IS USED TO FIX A SWASH PLATE

(75) Inventors: Kenji Saito, Ashikaga; Shigemi Shimizu, Sawa-gun, both of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/229,126

(22) Filed: Jan. 12, 1999

(30) Foreign Application Priority Data

Jan. 12, 1998 (JP) ..... 10-016371

(51) Int. Cl.[7] ..... F01B 3/00

(52) U.S. Cl. ..... 92/12.2; 92/71; 417/222.1; 91/499

(58) Field of Search ..... 92/71, 12.2; 417/222.1, 417/222.2; 91/499, 505; 74/839

(56) References Cited

U.S. PATENT DOCUMENTS 3,828,653 * 8/1974 Aldinger et al. ..... 91/498
4,030,404 * 6/1977 Meijer ..... 92/12.2
5,106,271 * 4/1992 Shimizu et al. ..... 417/222.1
5,292,233 3/1994 Takenaka et al. .
5,645,405 7/1997 Ota et al. .
5,984,643 * 12/1999 Ota et al. ..... 92/12.2

FOREIGN PATENT DOCUMENTS 2618556 11/1977 (DE) .
0366349 5/1990 (EP) .
0711918 5/1996 (EP) .
0903495 3/1999 (EP) .

OTHER PUBLICATIONS

European Search Report, Issued Sep. 1, 1999.

* cited by examiner

*Primary Examiner*—Edward K. Look
*Assistant Examiner*—Hermes Rodriguez
(74) *Attorney, Agent, or Firm*—Baker Botts L.L.P.

(57) ABSTRACT

In a swash plate type compressor, a swash plate (22) is fixed to a boss (21) by means of rivets (35). The swash plate is coupled to a plurality of pistons (24) via shoes (25). When a main shaft (16) is rotated to rotate a rotor (18), a rotational motion of the rotor is transmitted to the boss via a hinge mechanism (19) which changes an inclination of the swash plate. Accordingly, the boss is rotated to rotate the swash plate at the inclination to cause the pistons to make reciprocating motions in cylinders (26) via the shoes for performing a compressing operation.

11 Claims, 4 Drawing Sheets

SWASH PLATE TYPE COMPRESSOR IN WHICH A RIVET MEANS IS USED TO FIX A SWASH PLATE

BACKGROUND OF THE INVENTION

The present invention relates to a swash plate type compressor for use in, for example, an automobile air conditioner.

In a swash plate type compressor, a swash plate is mounted on a shaft which is rotated by an automobile engine. Pistons are indirectly coupled to the swash plate. When the swash plate is rotated together with the shaft, the pistons make reciprocating motions to compress fluid.

In a swash plate type compressor of a variable displacement type, a swash plate boss (which will be abbreviated hereinunder a boss) is coupled to a shaft via a rotor and a hinge mechanism at a variable inclination relative to the shaft. A swash plate is fixed to the boss. In this case, since pistons have a stroke corresponding to the inclination of the swash plate, the displacement of the compressor can be set variable.

In the conventional techniques, fixation of the swash plate relative to the boss has been carried out using a screw. However, since the swash plate type compressor generates various vibrations, there has been a problem of causing loosening of the screw. The loosening of the screw may cause separation of the swash plate from the boss, leading to breakage of the compressor. On the other hand, when welding is used for the fixation, welded portions should be made of the same material and further an influence of heat should be considered, so that it is disadvantageous in view of cost and quality.

SUMMARY OF THE INVENTION

It is therefore an object of the present invention to provide a swash plate type compressor wherein fixation of a swash plate is carried out reliably and inexpensively.

Other objects of the present invention will become clear as the description proceeds.

The present invention pays attention to fixation by a rivet rather than fixation by a screw which has been long used as a fixing means for fixation against vibration. It has been confirmed through experiments that use of the rivet is excellent for fixation against vibration.

According to an aspect of the present invention, there is provided a swash plate type compressor which comprises a rotated member subjected to a rotation motion, a swash member, a plurality of rivets fixing the swash member to the rotated member, a piston, and shoe means interposed between the swash member and the piston for moving the piston in response to movement of the swash member to perform a compression operation.

According to another aspect of the present invention, there is provided a swash plate type compressor, wherein a swash plate fixed to a boss is coupled to a plurality of pistons via shoes and, when a main shaft is rotated to rotate a rotor, a rotational motion of the rotor is transmitted to the boss via a hinge mechanism which changes an inclination of the swash plate, so that the boss is rotated to rotate the swash plate at the inclination to cause the pistons to make reciprocating motions in cylinders via the shoes for performing a compressing operation. The swash plate type compressor is characterized in that the swash plate is fixed to the boss by a plurality of rivets.

DESCRIPTION OF THE PREFERRED EMBODIMENTS

Figure 1:
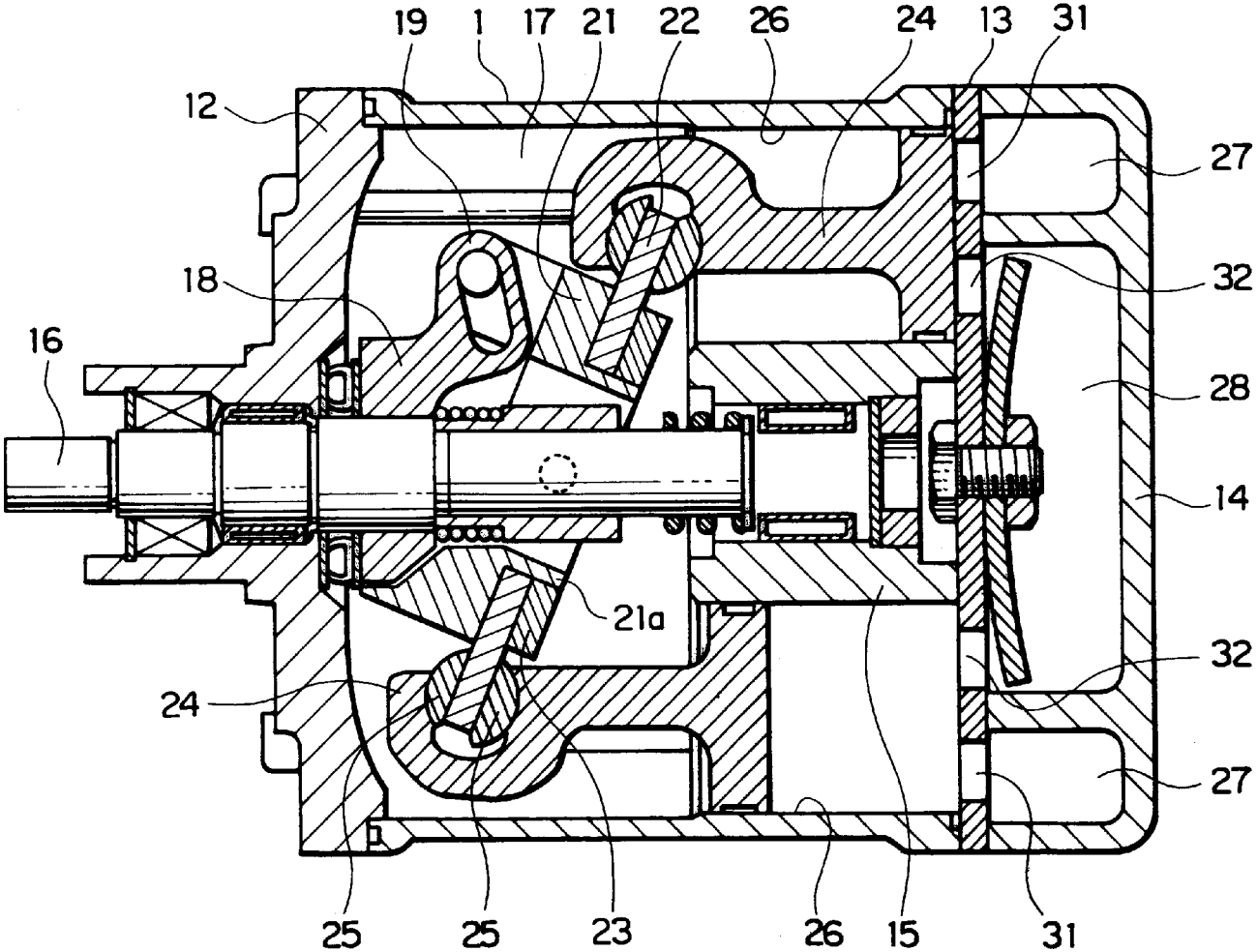
FIG. 1 RELATED ART
FIG. 1 is a longitudinal sectional view of a conventional swash plate type compressor.

Referring to FIG. 1, a conventional swash plate type compressor will be first explained for facilitating understanding of the present invention. The shown swash plate type compressor is of a variable displacement type and is used in an automobile air conditioner. The swash plate type compressor comprises a tubular casing 1, a front housing 12 closing one axial end of the casing 1, and a cylinder head 14 attached to the other axial end of the casing 1 via a valve plate assembly 13 interposed therebetween. A cylinder block 15 is integrally provided in the casing 1. A main shaft 16 extends at the center of the casing 1 and is supported by the front housing 12 and the cylinder block 15 so as to be rotatable. The shaft 16 is rotated with an automobile engine in the manner known in the art.

A crank chamber 17 is defined between the front housing 12 and the cylinder block 15. In the crank chamber 17, a rotor 18 is fixedly mounted on the shaft 16. A boss 21 is coupled to the rotor 18 via a hinge mechanism 19. The boss 21 is formed with a tubular portion 21*a*. An annular swash plate 22 is fitted over the tubular portion 21*a* and fixed to the boss 21 by means of an annular fixing screw 23. The hinge mechanism 19 allows an inclination of the swash plate 22 relative to an axis of the shaft 16 to be variable. The swash plate 22 is rotated together with the rotor 18.

A plurality of pistons 24 are coupled to the swash plate 22 at peripheral portions thereof via shoes 25, respectively. The pistons 24 are received in corresponding cylinder bores 26, formed in the cylinder block 15, so as to be slidable in an axial direction. When the swash plate 22 rotates, the pistons 24 make reciprocating motions in the corresponding cylinder bores 26 with a stroke determined according to the inclination of the swash plate 22.

The cylinder head 14 is formed at its peripheral portion with a suction chamber 27 and at its center with a discharge chamber 28. A known refrigeration circuit (not shown) is connected between the suction chamber 27 and the discharge chamber 28.

The valve plate assembly 13 is provided with suction holes 31 and discharge holes 32 for allowing the respective cylinder bores 26 to communicate with the suction chamber 27 and the discharge chamber 28, and further provided with corresponding valve mechanisms (not shown).

When the shaft 16 rotates, the rotor 18 rotates. The rotation of the rotor 18 is transmitted to the boss 21 via the hinge mechanism 19, so that the boss 21 and the swash plate 22 rotate in response to the rotation of the shaft 16. When the swash plate 22 rotates at an inclination relative to the shaft 16, the pistons 24 make reciprocating motions in the corresponding cylinder bores 26. Following the reciprocating motions of the pistons 24, refrigerant gas in the refrigeration circuit is sucked into the cylinder bores 26 via the suction chamber 27 and the suction holes 31 and then discharged into the discharge chamber 28 via the discharge holes 32 so as to be supplied to the refrigeration circuit.

The effective cylinder displacement is determined by the inclination of the swash plate 22. FIG. 1 shows a state of the maximum inclination of the swash plate 22, wherein the stroke of each piston 24 is maximum so that the effective cylinder displacement is also maximum. By means of the hinge mechanism 19, the inclination of the boss 21, i.e. the swash plate 22, can be changed.

Figure 2:
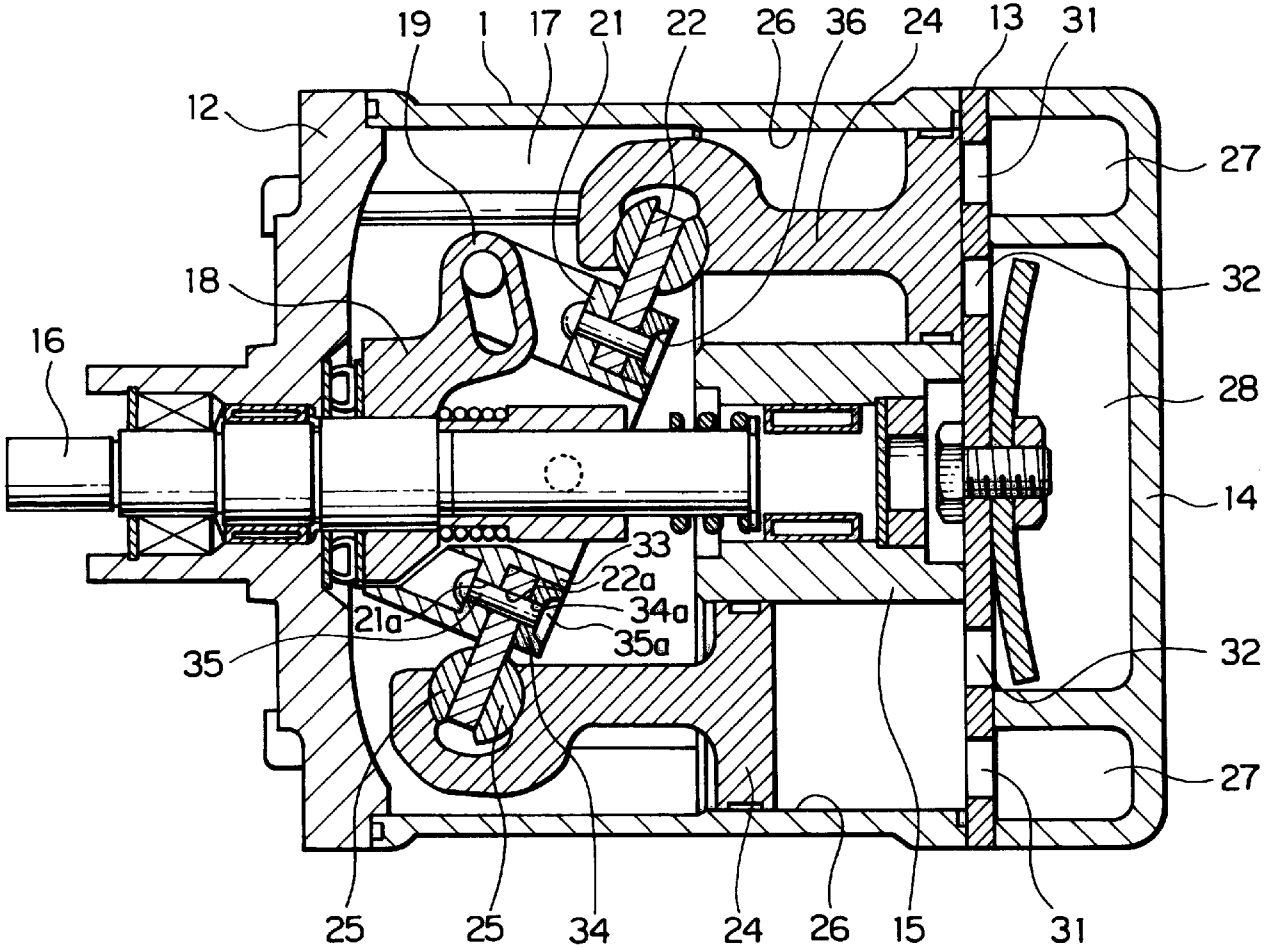
FIG. 2 is a longitudinal sectional view of a swash plate type compressor according to a first preferred embodiment of the present invention.

Referring now to FIG. 2, a swash plate type compressor according to the first preferred embodiment of the present invention will be described hereinbelow. Similar portions are designated by like reference numerals.

The swash plate type compressor includes an annular fixing plate 34, behind the swash plate 22, fitted over a tubular portion 33 of the boss 21, and a plurality of rivets 35 fixing the fixing plate 34 and the swash plate 22 relative to the boss 21. The fixing plate 34 is made of a mild steel. The rivets 35 are made of a carbon steel. It is preferable that the rivets 35 are made of a cold-rolled carbon steel. A combination of the shaft 16, the rotor 18, the hinge mechanism 19, and the boss 21 is referred to as a rotated member.

The swash plate 22 is of a ring shape and fitted outside the tubular portion 33 of the boss 21 to be superposed on the boss 21 in a predetermined direction. The fixing plate 34 is superposed on the swash plate 22 in the predetermined direction. A combination of the swash plate 22 and the fixing plate 34 is referred to as a swash member.

The boss 21, the swash plate 22, and the fixing plate 34 are formed with rivet holes 21*a*, 22*a*, and 34*a*, respectively. Each of the rivets 35 extends in a predetermined direction through the rivet holes 21*a*, 22*a*, and 34*a* and has heads 35*a* and 35*b* engaged with the fixing plate 34 and the boss 21 in the predetermined direction, respectively. The fixing plate 34 has a plurality of concave portions 36 each of which receives the head 35*a* of each of the rivets 35. In other words, the fixing plate 34 is formed with the concave portions 36 for preventing the heads 35*a* of the rivets 35 from projecting, so as not to interfere with the movement of the swash plate 22 and not to increase an axial length of the assembly.

Fixation by the rivets 35 can be easily carried out by a known technique and can be securely maintained without being loosened even being subjected to vibration.

Since recent swash plate type compressors are long in running duration favored by improvement in performance thereof, it is not necessary to change the swash plate 22. Therefore, there will be raised no practical problem even if the swash plate 22 is fixed to the boss 21 by the rivets 35.

Figure 3:
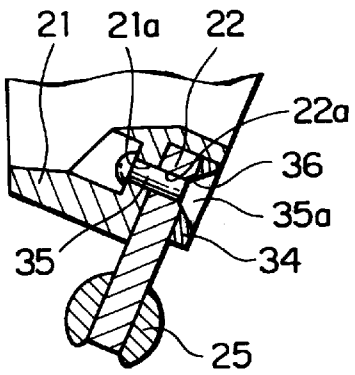
FIG. 3 is a sectional view showing a main part of a swash plate type compressor according to a modification of the first preferred embodiment.

Referring now to FIG. 3, a modification of the foregoing first preferred embodiment will be described. In the modification, the concave portion 36 extends into the swash plate 22 through the fixing plate 34. In this case, a length of a portion fixed by the rivets 35, for example, the sum of lengths of the boss 21, the swash plate 22 and the fixing plate 34, can be reduced.

Figure 4:
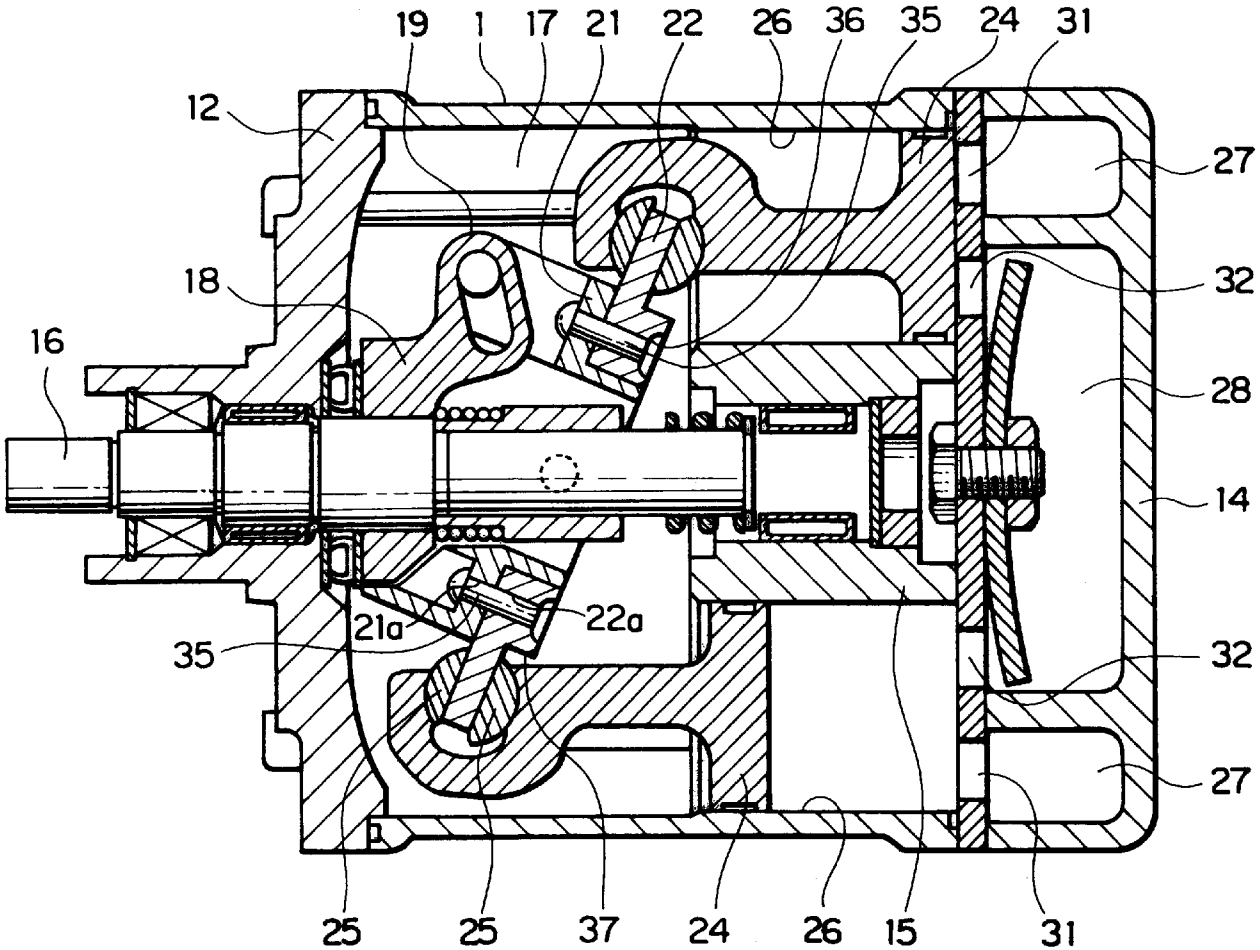
FIG. 4 is a longitudinal sectional view of a swash plate type compressor according to a second preferred embodiment of the present invention.

Referring now to FIG. 4, a swash plate type compressor according to the second preferred embodiment of the present invention will be described. Similar portions are designated by like reference numerals.

In the swash plate type compressor, the swash plate 22 is fixed to the boss 21 directly by the rivets 35. For facilitating the direct fixation by the rivets 35, the swash plate 22 is integrally formed with a tubular portion 37 corresponding to the fixing plate 34. This means that the swash plate 22 and the fixing plate 34 are formed integral with each other. In this case, the swash plate 22 is referred to as a swash member alone. With this arrangement, the number of the parts can be reduced.

Figure 5:
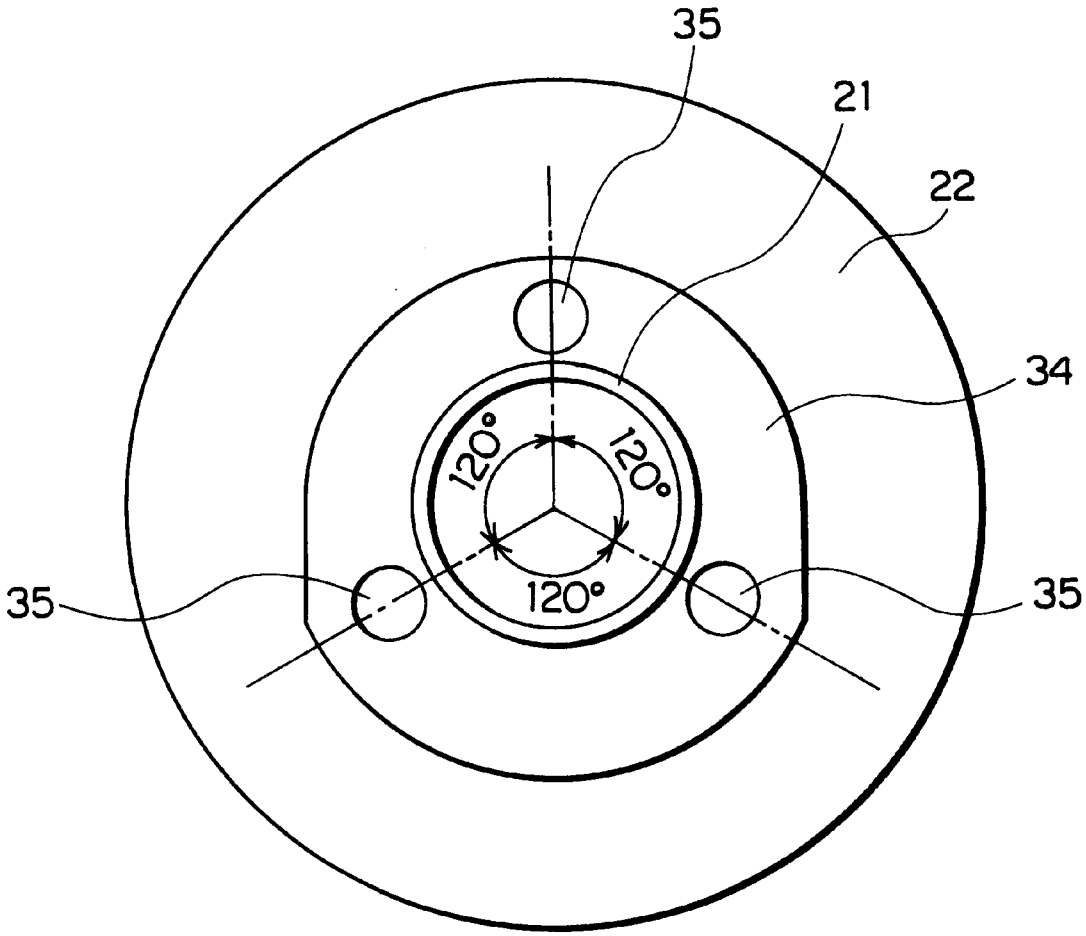
FIG. 5 is a plan view of a combination of a boss, a swash plate, and a fixing plate which are included in each of the compressors of FIGS. 2 and 4.

Referring to FIG. 5, the description is made as regards a modification of a combination of the boss 21, the swash plate 22, and the fixing plate 34. As shown in the modification, it is preferable that use is made of three rivets 35 arranged at positions which have an angle of 120° therebetween.

According to each of the foregoing preferred embodiments, since the rivets are used as fixing means in the swash plate type compressor which is frequently subjected to vibration, the fixed portion is prevented from loosening so that the secure fixation can be ensured. The fixation by the rivets can be quickly carried out and is far less inexpensive as compared with the conventional fixation by the screw, thereby leading to large reduction in production cost of the compressor.

While the present invention has thus far been described in connection with a few embodiments thereof, it will readily be possible for those skilled in the art to put this invention into practice in various other manners. For example, for eliminating projecting portions of the rivets, concave portions may be provided corresponding to both heads of the rivets.

What is claimed is:

1. A swash plate type compressor comprising:

a rotated member, including a rotor engaged with a main shaft in a rotation direction thereof, subjected to a rotation motion;

a swash member;

a plurality of rivets fixing said swash member to said rotated member;

a piston; and shoe means interposed between said swash member and said piston for moving said piston in response to movement of said swash member to perform a compression operation.

2. A swash plate type compressor as claimed in claim 1, wherein said rotated member further comprises:

said main shaft rotated in response to said rotation motion;

a boss fixed to said swash member by said rivets; and a hinge mechanism between said rotor and said boss for changing an inclination of said swash member relative to said main shaft.

3. A swash plate type compressor comprising:

a rotated member subjected to a rotation motion;

a swash member;

a plurality of rivets fixing said swash member to said rotated member;

a piston; and shoe means interposed between said swash member and said piston for moving said piston in response to movement of said swash member to perform a compression operation, wherein each of said rivets extends in a predetermined direction and has a head engaged with said swash member in the predetermined direction, said swash member having a plurality of concave portions each of which receives said head of each of the rivets.

4. A swash plate type compressor as claimed in claim 3, wherein said swash member is superposed on said rotated member in said predetermined direction.

5. A swash plate type compressor as claimed in claim 4, wherein said rotated member has a tubular portion extending in said predetermined direction, said swash member being of a ring shape and fitted outside said tubular portion.

6. A swash plate type compressor as claimed in claim 3, wherein said swash member comprises:

a swash plate superposed on said rotated member in said predetermined direction; and a fixing plate superposed on said swash plate in said predetermined direction.

7. A swash plate type compressor as claimed in claim 6, wherein said concave portions are formed in said fixing plate.

8. A swash plate type compressor as claimed in claim 6, wherein said concave portions are formed to extend to said swash plate through said fixing plate.

9. A swash plate type compressor as claimed in claim 6, wherein said swash plate and said fixing plate are formed integral with each other.

10. A swash plate type compressor, wherein a swash plate fixed to a boss is coupled to a plurality of pistons via shoes and, a rotational motion of said rotor is transmitted to said boss via a hinge mechanism which changes an inclination of said swash plate, so that said boss is rotated to rotate said swash plate at said inclination to cause said pistons to make reciprocating motions in cylinders via said shoes for performing a compressing operation, characterized in that said swash plate is fixed to said boss by a plurality of rivets.

11. A swash plate type compressor as claimed in claim 10, wherein said swash plate is fitted over said boss and fixed to said boss by said rivets via a fixing plate so that said swash plate is interposed between said boss and said fixing plate.

* * * * *